United States Patent [19]

Monette

[11] Patent Number: 4,751,912

[45] Date of Patent: Jun. 21, 1988

[54] DETECTION OF EXHAUST GAS SPILLAGE FROM NATURALLY ASPIRATED GAS FURNACES AND NATURALLY ASPIRATED GAS HOT WATER HEATERS

[76] Inventor: Michael Monette, 313 Robin La., Ottawa, Canada, K1Z 7J9

[21] Appl. No.: 894,080

[22] Filed: Aug. 6, 1986

[51] Int. Cl.[4] ..... F23J 11/00

[52] U.S. Cl. ..... 126/307 A; 431/22; 116/216; 116/217; 374/162

[58] Field of Search ..... 126/307 A, 307 R, 312; 431/20, 22; 116/216, 217, DIG. 41; 374/161, 162

[56] References Cited

U.S. PATENT DOCUMENTS

| | | | |
|---|---|---|---|
| 2,308,087 | 1/1943 | Lappala | 116/216 |
| 3,576,761 | 4/1971 | Davis | 374/162 |
| 4,150,572 | 4/1979 | Lindquist | 116/217 |
| 4,189,942 | 2/1980 | Giezen et al. | 116/216 |
| 4,280,441 | 7/1981 | McNeely | 116/217 |
| 4,459,046 | 7/1984 | Spirg | 116/216 |

FOREIGN PATENT DOCUMENTS

| | | | |
|---|---|---|---|
| 2260517 | 7/1974 | Fed. Rep. of Germany | 431/22 |

*Primary Examiner*—James C. Yeung
*Attorney, Agent, or Firm*—David J. French

[57] ABSTRACT

A device for detecting the diversion of gas furnace or gas hot water heater exhaust into a dwelling due to chimney backdrafting detects a sustained rise in the temperature of the gases passing through the draft-diverter orifice. A significant rise in temperature indicates that the above condition has occurred. This temperature rise is recorded only after the condition has persisted for a sufficiently long period of time, thereby avoiding the recording of temporary backdrafting conditions which are not required to be recorded. The device consists of a high temperature resistant plastic strip or other material with similar conductivity and specific heat qualities with a temperature sensitive color-change material mounted on the surface of the plastic strip at one end of the strip. This strip is attached to the furnace or gas hot water heater in a preferred location with the color-change material facing away from the normal flow of backdrafting exhaust gases. Heat from the backdrafting flow causes the color-change material to change color once the heat in the gas flow has penetrated through the underlying plastic strip. An aerodynamic stagnation zone on the front face of the plastic strip during a backdraft condition prevents the color-change material from changing color prematurely.

19 Claims, 4 Drawing Sheets

DETECTION OF EXHAUST GAS SPILLAGE FROM NATURALLY ASPIRATED GAS FURNACES AND NATURALLY ASPIRATED GAS HOT WATER HEATERS

FIELD OF THE INVENTION

This invention detects conditions in which a naturally aspirated gas furnace or domestic gas-fired hot water heater with open draft diverter is or has been exhausting gases into a dwelling rather than out of the dwelling via the chimney. More particularly this invention provides a means for detecting when furnace or gas hot water heater gases are passing into the surrounding area of a furnace because the chimney is in a backdraft or blocked condition, rather than the gases exiting the dwelling via the normal operation of the chimney and flue.

BACKGROUND TO THE INVENTION

Furnace or gas hot water heater combustion exhaust gases are commonly vented through a chimney under the forces of natural air buoyancy. The natural tendency of hot gases is to rise. When hot rising flue gases are contained within a chimney, they tend to create a suction or reduced pressure condition at the base of the chimney. Under normal conditions this would sweep all of the products of combustion out of the dwelling via the chimney.

Under certain conditions within a dwelling the phenomenon of backdrafting may occur. Backdrafting is the reversed flow of air or gas through the chimney, from outdoors to indoors via the chimney. This occurs when the air pressure at the base of the chimney is less than the air pressure at the top of the chimney. In this condition outside air flows down the chimney into the dwelling and indoor air escapes through other openings, orifices or ventilation systems in the building envelope.

A low air pressure condition in a house can arise from forced air ventilation or from a separate fireplace that is drawing house air itself. Such a condition is more likely to arise, and be more pronounced, when the house is relatively air tight. Then the only major source for make-up air is commonly the furnace chimney. Backdrafting is also more likely to be persistent in a cold climate once the downward flow of relatively cold, dense outside air has thoroughly cooled the chimney and eliminated any tendency for the chimney to generate a natural upwards draft.

A chimney in a backdraft condition is not dangerous per se. But when it is coupled to a furnace, and particularly a gas furnace equipped with an open draft diverter air inlet, dangerous products of combustion are often diverted into the dwelling. Once a hot flow of exhaust gases into the dwelling has been established the backdraft flow of colder air down the chimney may not be overcome. The chimney may fail to re-establish its draft under conditions where the pressure at the base of the chimney is less than the weight of the column of cold air in the flue and chimney system. If the chimney is backdrafting the furnace exhaust gases will not exit via the chimney but will enter the dwelling via the draft diverter opening, reducing the indoor air quality level.

The phenomenon of backdrafting and resulting exhaust gas spillage into the dwelling can be complex to detect directly since direct detection would require the measurement of relative air pressures or gas flows. A cheap and effective means of detecting exhaust gas spillage is therefore desirable. In particular, it is desirable to identify a cheap and effective means for detecting the escape of combustion exhaust gas into a dwelling which has a chimney in a backdrafting condition.

A similar case of exhaust gas spillage into the dwelling occurs when the chimney pipe passage is blocked for any reason. Blockage of the chimney passage may occur as a result of faulty workmanship on the chimney flue or due to the accumulation of foreign matter such as animal nests or leaves anywhere along the flue and chimney passage. In some cases flue gases condense on the colder chimney liner leading to the buildup of corrosive liquids on the inner surface of the chimney pipe and liner. This corrosive liquid deteriorates the chimney passage leading to structural failure and blockage of the chimney passage.

The phenomenon of blocked chimney passages can also be difficult to detect directly since the direct detection requires measurement of the relative air pressures or gas flows.

Similar backdrafting conditions occur with naturally aspirated gas hot water heaters which also have an open draft diverter section.

In all cases, backdrafting exhaust gases into the home introduce undesirable combustion products into the indoor living space, and in some cases will lead to the build-up of hazardous carbon monoxide gas in the indoor living space.

It is common for naturally aspirated gas furnaces to backdraft for a short period, normally less than 30 seconds, during start up of the furnace. These initial transient backdraft conditions are not generally hazardous and if detected by a backdraft sensing means would constitute a false signal. Therefore, the detecting means must be resistant to such transient backdrafting conditions but remain sensitive to prolonged backdrafting conditions which tend to persist for more than 30 seconds.

The sensing means must also be designed to avoid false alarms from other normal conditions occurring within and near the furnace during normal operation, such as the normal emanation of heat from the furnace panels or the presence of hot gas flows within the proper flow passages in the furnace.

PRIOR ART

In Tornquist (U.S. Pat. No. 2,184,983; 1939) the need to prevent the operation of a fuel burning heating appliance during chimney backdrafting conditions is described. Tornquist claims a temperature sensing means comprised of temperature responsive contact devices which will disable the operation of the burner during abnormal conditions of exhaust gas flow. Wamsler-Herd (German Pat. No. 2,260,517) introduces the use of a bi-metallic temperature sensor serving as the means of sensing an improper backdrafting condition. Wamsler-Herd places the sensing device in the path of the flow of escaping gases from the furnace into the dwelling, locating said sensing means along the lower border of the outside of the draft opening. Ignazio (U.S. Pat. No. 3,537,803; 1970) shows a thermally activated contact disk mounted in a flow collecting assembly which is designed to be mounted at the top of a draft diverter opening during conditions of backdrafting. Similarly, in Smith (U.S. Pat. No. 4,079,727) a safety contact switch is located in the path of backdrafting exhaust gases caused to follow a nonstandard flow path due to the special venting system described by Smith.

The prior art indicates the general need for a backdrafting detection system in order to cause the cessation of dangerous exhaust gas backdrafting. Various means are described involving the use of temperature sensitive contact disks or thermistors serving to actuate safety devices or lead to the stoppage of the furnace burner. A general indication is given that the backdraft detection means must be placed in the path of abnormal gas flow.

This invention recognizes these requirements and improves upon them substantially as is described below.

FURTHER BACKGROUND TO THE INVENTION

The backdraft sensing means must be located in the path of abnormal gas flow. If no changes are made to the furnace (in contrast to Smith's special draft chamber), locating the sensing means along the upper surface (as in Ignazio) would lead to an excess of false alarms. During temporary spillage conditions the greatest temperature rise occurs along the upper edge of the draft diverter opening. Also, with the automatic damper installed on many furnaces, on furnace shut-down the chimney damper closes and a temporary temperature rise occurs, again along the upper edge of the draft diverter opening. For these reasons the upper edge location for the sensing means is not recommended for reliable sensor operation and avoidance of false alarms. Rather, the sensing means should be located along the lower edge of the draft chamber opening, and more specifically, at a central point along the lower edge of the draft chamber opening.

Based on the knowledge that the sensing means should be placed along the lower edge of the draft diverter opening in the case of a vertical draft diverter opening, a thorough understanding of the thermodynamics of the exhaust gas flow is required. During normal furnace operation, cooler room air passes over the lower edge of the draft chamber, ensuring that the temperature does not rise beyond approximately 10 degrees Celsius over ambient. However, during a backdraft condition, the temperature rise depends upon the flow of hot gases leaving the combustion chamber and exiting through the draft diverter opening and the magnitude and temperature of the outdoor air flow entering into the draft diverter chamber from the outdoors via the chimney.

During a backdraft condition, if the backdraft is slight the proportion of outdoor air mixing with air leaving the combustion chamber is low, and the resulting temperature of the gas flow exiting the draft diverter opening is highest. During a strong backdraft, a greater proportion of the air flow is from outdoors leading to a cooler air flow stream. In very cold conditions (−20 degrees Celsius) with a very strong backdraft the mixed flow stream temperature may only reach 60–70 degrees Celsius. However, in such a case the greater proportion of outdoor air entering into the indoor air space serves to dilute the combustion gases reducing the hazard from that of a milder backdraft condition.

During conditions of partial transitory spillage the temperature along the lower edge of the draft chamber does not rise greatly while the temperature along the upper edge of the draft chamber may exceed 50 degrees Celsius over ambient conditions. A similar condition occurs with a furnace which has been operating and then ceases to operate normally leading to the closing of an automatic flue damper.

Given these characteristics of the gas flow stream, the desired sensing means must be resistant to false alarms due to transitory spillage conditions or temporary backdrafts occurring for up to 30 seconds, be sensitive to backdrafts causing mixed gas flow streams at the draft diverter opening of 70–200 degrees Celsius and be capable of an upper service temperature of approximately 300 degrees Celsius. The inventions claimed in prior art do not fully address the issues of false alarms or dynamics of the flow stream as it affects their reliability. The benefits of this invention are now described.

SUMMARY OF THE INVENTION

In order to reduce the cost of the sensing means to its lowest possible level the invention comprises no mechanical apparatus. Rather, it is a visual indicating means, which upon occurrence of a prolonged backdraft (as defined as being in excess of 30 seconds) registers a positive and defined color-change, irreversibly. This color-change is achieved by the use of commercially available materials which change color when a defined temperature is exceeded, said material not being the subject of this invention. Rather the invention comprises the application of this material onto a suitable strip of material of defined conductivity, specific heat capacity and dimensions which is adapted to be mounted onto the furnace via an appropriate fastening means.

In its preferred embodiment, the heat sensitive color-change material of a predetermined temperature response range is mounted on the front face of a specifically sized plastic substrate. The plastic substrate size and properties are chosen to prevent degradation of the substrate when placed according to the invention and to provide aerodynamic buffering of the color-change material from the direct flow of the backdrafting exhaust gases. The substrate may also be narrowed down between the point of attachment to the combustion appliance and the color-change material to reduce the amount of direct conductive heat flow between the combustion appliance housing and the phase change material. The specific heat capacity of the material is also a factor as it affects the degree of thermal buffering offered by the substrate material. The substrate material is selected to reduce the flow of heat due to conduction (conductivity), thereby delaying the temperature rise on the surface of the substrate facing away from the impinging hot gases during a combustion exhaust gas backdraft condition.

An optimal size and thickness of Lexan brand substrate has been found as a result of testing and analysis of the thermodynamic conditions occurring in the draft diverter opening of naturally aspirated gas furnaces and naturally aspirated gas hot water heaters. A preferred defined response temperature to provide optimal performance in conjunction with this substrate was found to be 66 degrees Celsius.

DESCRIPTION OF THE PREFERRED EMBODIMENTS

Figure 1:
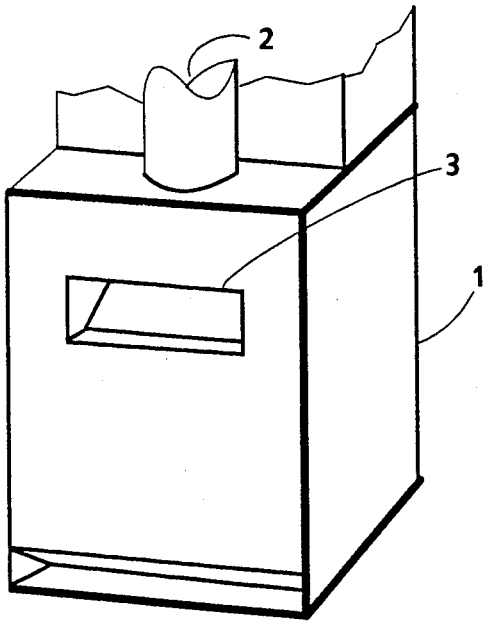
FIGS. 1 is a schematic isometric drawing of a conventional gas furnace with the backdrafting sensing means located at the lower front edge of the open draft diverter chamber, depicted in the enlargement, FIG. 1*a*.
Figure 1A:
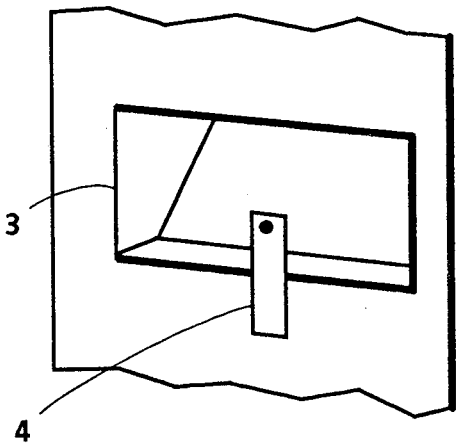

In FIG. 1 a gas furnace 1 with a chimney flue 2 is provided with a rectangular flue gas diverter opening 3. The detector strip 4, which is the subject of this invention, is shown in FIG. 1a mounted at the center of the lower edge of the diverter opening 3.

Figure 2:
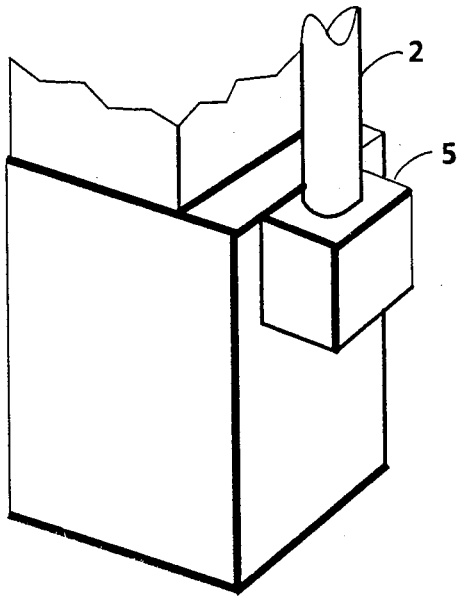
FIG. 2 is a schematic isometric drawing of a conventional gas furnace with the backdrafting sensing means located at the side lower edge of the downward facing open draft diverter chamber, depicted in the enlargement, FIG. 2a, FIG. 3 is a schematic isometric drawing of a conventional gasfired hot water heater with the backdrafting sensing means located bridging the open draft diverter chamber.
Figure 2A:
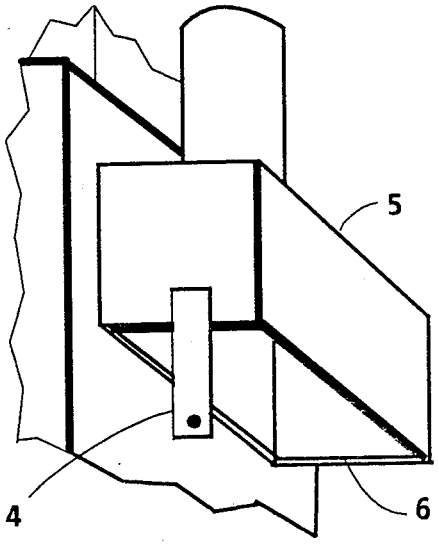

In FIG. 2, an alternate type of diverter, in the form of an open-ended box 5 is shown mounted between the furnace 1 and the flue pipe 2. The detector strip 4 is shown in FIG. 2a mounted along the border of the lower opening 6 of the diverter box 5.

Figure 3:
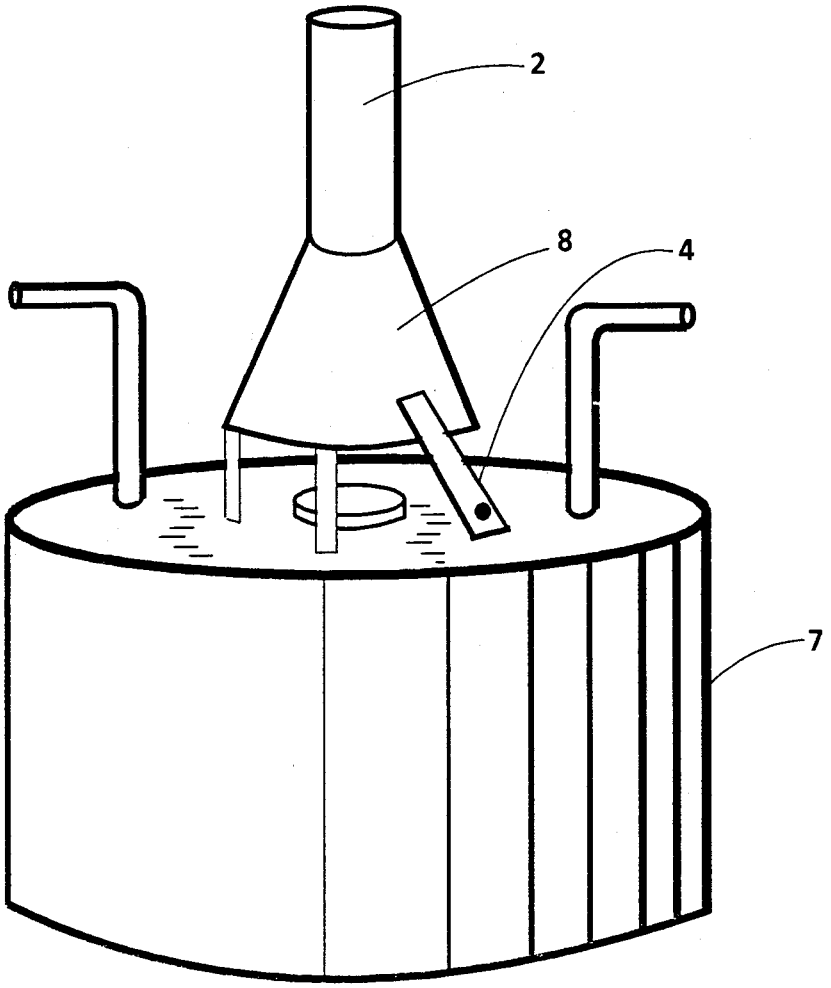

In FIG. 3 a hot water tank 7 has a chimney flue 2 with a conical draft diverter shroud 8. The detector strip 4 is mounted at the lower edge of the conical shroud 8.

In FIGS. 1, 2 and 3 the detector strip is located at positions whereby the substrate material of the strip is not subjected to temperatures that would lead to premature color-change of the color-change material due to conductive heat flow the point of attachment, through the substrate material and to the color-change material. The detector strip projects into the zone where backdrafting exhaust gases will flow during a combustion exhaust gas backdraft. The detector strip is located on the side of the substrate facing away from the direction of the backdrafting exhaust gas flow, that is, on the side facing away from the combustion appliance.

Figure 4:
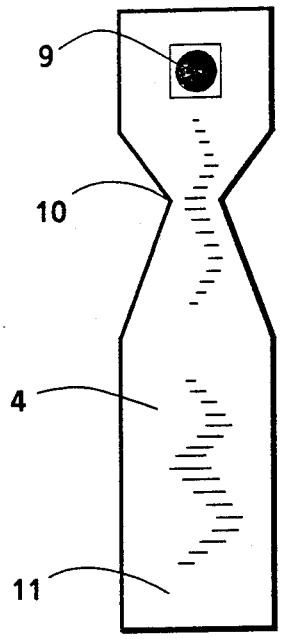
FIG. 4 is a full size drawing of the preferred embodiment of the invention, front view.
Figure 4A:
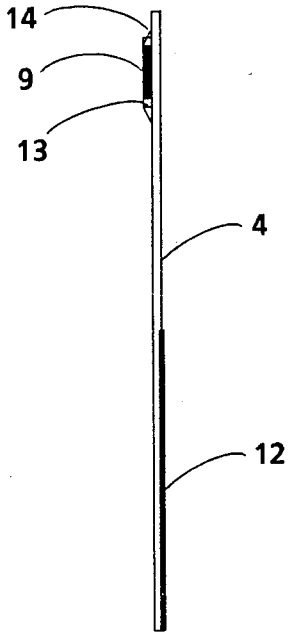
FIG. 4a is a sideview.

In FIG. 4 a front view of a preferred form of the detector strip 4 is shown. A quantity of temperature sensitive irreversible color-change material 9 is mounted on the upper end of the strip 4, in the form an enlarged dot. This material is mounted within a carrier matrix 13 and the combined unit is held in place by a transparent adhesive tape 14. Below this dot of color-change material 9 the strip has a narrowed region 10, intended to limit conduction of heat from the attachment end 11 of the strip 4. This is an optional feature and is unnecessary when the strip is fastened to a relatively cool support structure. FIG. 4 shows the detector strip 4, which is preferably built-up on a plastic substrate of predetermined thickness. For purposes of attachment, it has been found to use an adhesive 12, of double-sided tape with an epoxy based glue, satisfactory.

Figure 5:
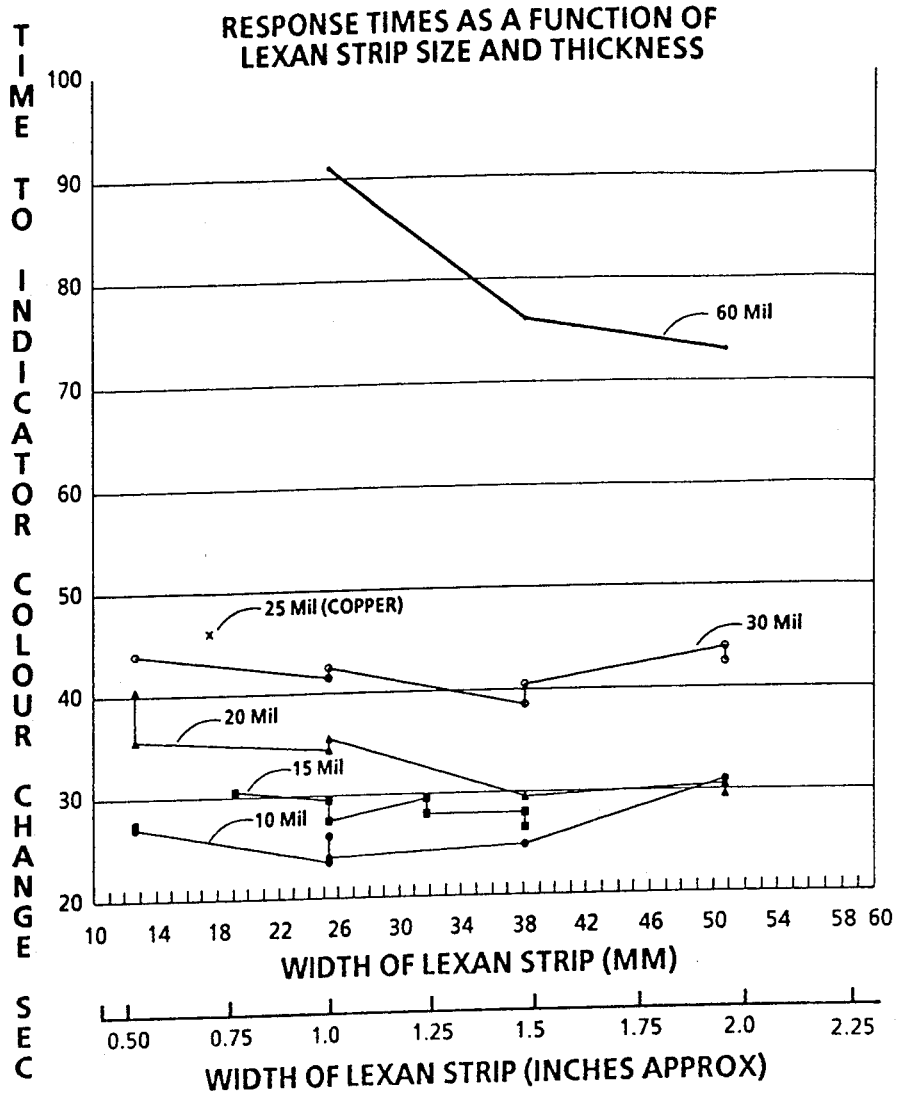
FIG. 5 is a graph showing various response curves for differing thicknesses of plastic substrate.

In FIG. 5 various response curves are shown for different thicknesses of polycarbonate plastic substrate (effectively varying the total resistance between hot and cold side of the strip and thermal heat capacity [plus a one point curve for a copper substrate used as a benchmark]). Based on this data and the knowledge from field testing it has been found that a 30 Mil thick Lexan brand polycarbonate strip which offers the optimal performance conditions. The desired specific heat capacity of the substrate material for the dimensions provided below is in the range of 0.25 to 0.35 Btu/lb/°F., and the preferred material conductivity is between 1.0 and 1.6 Btu/hr/ft$^2$/°F./in. Preferred values for these parameters have been found to be 1.35 Btu/hr/ft$^2$/°F./in. and 0.30 Btu/lb/°F. The color-change material may be responsive in the range of 50°–100° C., but 66° C. has been found appropriate.

The dimensions of the detector strip may conveniently be between 0.75" and 1.5" in width and between 2.5" and 5" in length. Preferred dimensions have been found to be 1 inch in width and 4 inches in length. The width of the substrate is chosen to ensure that an aerodynamic stagnation zone occurs on the face of the sensing material, thereby offering an aerodynamic shield for the sensing material from the actual hot gas flow. In FIG. 5 it can be seen that the response time tends to increase as the substrate material decreases in width, although the effect of varying width does not have a major effect on the response time for thinner substrates. For thicker substrates, as the width increases the substrate begins to both absorb more of the heat from the gas flow stream due to increased surface area and the air flow on the sensor material side of the substrate becomes more turbulent leading to increased heat transfer from the flow stream to the surface and a reduced response time. Additionally, the substrate is sized to prevent obstruction of normal flows of air through the draft divert opening during normal operation of the combustion appliance.

The substrate material is ideally 30/1000" thick (or in a range of 25/1000"–40/1000"), which offers a response time of approximately 40 seconds as shown in FIG. 5 and corresponds to an optimum performance condition. This thickness of Lexan provides for the precise degree of thermal conductivity and thermal mass warming to both offer false alarm protection and yield response of the color-change material when a prolonged exhaust gas backdraft occurs.

The foregoing constitutes a description of the preferred embodiment of the invention. The invention in its broadest and more particular aspects is defined by the claims which follow.

I claim:

1. A device for detecting the prolonged diversion of combustion exhaust gases into a dwelling through the flue gas diverter opening of a gas-fired furnace or hot water heater comprising:

(a) a strip of temperature resistant material of relatively thin thickness and extended longitudinal dimension, (b) said strip having on one end thereof attachment means adapted to fasten said strip along the border of a flue gas diverter opening, with one surface facing outwardly in the direction of flow of diverted flue gas, (c) said strip having deposited on its surface at its other end a temperature sensitive irreversible color-change material, located on the outwardlyfacing surface of said strip, wherein the material and dimensions of said strip have been selected to provide a predetermined delay in the rise of the temperature of said color-change material to combustion exhaust gases being diverted through a flue gas diverter, so as to provide a delayed indication of the flow of combustion exhaust gases through said flue gas diverter.

2. A device as in claim 1 wherein the color-change material changes color at a temperature within the range of 50°–100° C.

3. A device as in claim 1 wherein the material of said strip is a hydro-carbon based plastic with a thermal conductivity of 1.0–1.6 Btu/hr/ft$^2$/in and a specific heat capacity of 0.25–0.35 Btu/lb/°F. and said strip is between 0.75 to 1.5 inches width, 2.5 to 5.0 inches length and 25–40 thousandths of an inch in thickness.

4. A device as described in claim 3 in which the material of said strip is a polycarbonate plastic.

5. A device as in claim 1 wherein said attachment means comprises an adhesive capable of sustaining temperatures up to 100° C.

6. A device as in claim 1 wherein the color-change material changes color at a temperature in the vicinity of 66° C.

7. A device as in claim 1 wherein said color-change material changes color at a temperature within the range of 50°–100° C., and wherein said attachment means comprises an adhesive capable of sustaining temperatures up to 100° C.

8. A device as in claim 1 wherein said color-change material changes color at a temperature within the range of 50°–100° C., and wherein said attachment means comprises an adhesive capable of sustaining temperatures up to 100° C. and wherein the material of said strip is a hydro-carbon based plastic with a thermal conductivity of 1.0–1.6 Btu/hr/ft2/in and a specific heat capacity of 0.25–0.35 But/lb/°F. and said strip is between 0.75 to 1.5 inches width, 2.5 to 5.0 inches length and 25–40 thousandths of an inch in thickness.

9. A device as in claim 1 wherein the material of said strip is a hydro-carbon based plastic with a thermal conductivity of 1.0–1.6 Btu/hr/ft2/in and a specific heat capacity of 0.25–0.35 But/lb/°F. and said strip is between 0.75 to 1.5 inches width, 2.5 to 5.0 inches length and 25–40 thousandths of an inch in thickness and wherein said color change material changes color at a temperature in the vicinity of 66° C.

10. A device as in claim 1 wherein the material of said strip is a poly carbonate plastic with a thermal conductivity of 1.0–1.6 Btu/hr/ft2/in and a specific heat capacity of 0.25–0.35 But/lb/°F. and said strip is between 0.75 to 1.5 inches width, 2.5 to 5.0 inches length and 25–40 thousandths of an inch in thickness and wherein in the material of said strip is a poly-carbonate plastic, and wherein said color change material changes color at a temperature in the vicinity of 66° C.

11. A gas-fired furnace or hot water heater having a flue gas diverter opening and a device for detecting the prolonged diversion of combustion exhaust gases through said flue gas diverter opening, said device comprising:

(a) a strip of temperature resistant material of relatively thin thickness and extended longitudinal dimension, (b) said strip having on one end thereof attachment means adapted to fasten said strip along the border of a flue gas diverter opening, with one surface facing outwardly, in the direction of flow of diverted flue gas, (c) said strip having deposited on its surface at its other end a temperature sensitive irreversible color-change material, located on the outwardlyfacing surface of said strip, wherein the material and dimensions of said strip have been selected to provide a predetermined delay in the rise of the temperature of said color-change material to combustion exhaust gases being diverted through a flue gas diverter, so as to provide a delayed indication of the flow of combustion exhaust gases through said flue gas diverter.

12. A furnace or heater as in claim 11 wherein the color-change material changes color at a temperature within the range of 50°–100° C.

13. A furnace or heater as in claim 11 wherein the material of said strip is a hydrocarbon based plastic with a thermal conductivity of 1.0–1.6 But/hr/ft$^2$/in. and a specific heat capacity of 0.25–0.35 But/lb/°F. and said strip is between 0.75 to 1.5 inches width, 2.5 to 5.0 inches length and 25–40 thousandths of an inch in thickness.

14. A furnace or heater as described in claim 13 in which the material of said strip is a polycarbonate plastic.

15. A furnace or heater as in claim 11 wherein the color-change material changes color at a temperature in the vicinity of 66° C.

16. A furnace or heater as in claim 11 wherein said color-change material changes color at a temperature within the range of 50°–100° C., and wherein said attachment means comprises an adhesive capable of sustaining temperatures up to 100° C.

17. A furnace or heater as in claim 11 wherein said color-change material changes color at a temperature within the range of 50°–100° C., and wherein said attachment means comprises an adhesive capable of sustaining temperatures up to 100° C. and wherein the material of said strip is a hydrocarbon based plastic with a thermal conductivity of 1.0–1.6 But/hr/ft$^2$/in. and a specific heat capacity of 0.25–0.35 But/lb/°F. and said strip is between 0.75 to 1.5 inches width, 2.5 to 5.0 inches length and 25–40 thousandths of an inch in thickness.

18. A furnace or heater as in claim 11 wherein the material of said strip is a hydrocarbon based plastic with a thermal conductivity of 1.0–1.6 But/hr/ft$^2$/in. and a specific heat capacity of 0.25–0.35 But/lb/°F. and said strip is between 0.75 to 1.5 inches width, 2.5 to 5.0 inches length and 25–40 thousandths of an inch in thickness and wherein said color-change material changes color at a temperature in the vicinity of 66° C.

19. A furnace or heater as in claim 11 wherein the material of said strip is a polycarbonate plastic with thermal conductivity of 1.0–1.6 But/hr/ft$^2$/in. and a specific heat capacity of 0.25–0.35 But/lb/°F. and said strip is between 0.75 to 1.5 inches width, 2.5 to 5.0 inches length and 25–40 thousandths of an inch in thickness and wherein the material of said strip is a poly-carbonate plastic, and wherein said color change material changes color at a temperature in the vicinity of 66° C.

* * * * *